US007969428B2

(12) United States Patent
Miller et al.

(10) Patent No.: US 7,969,428 B2
(45) Date of Patent: Jun. 28, 2011

(54) COLOR DISPLAY SYSTEM WITH IMPROVED APPARENT RESOLUTION

(75) Inventors: Michael E. Miller, Honeoye Falls, NY (US); Ronald S. Cok, Rochester, NY (US); Paul J. Kane, Rochester, NY (US); Michael J. Murdoch, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 1451 days.

(21) Appl. No.: 11/429,884

(22) Filed: May 8, 2006

(65) Prior Publication Data

US 2007/0257946 A1 Nov. 8, 2007

(51) Int. Cl.
*G09G 5/00* (2006.01)

(52) U.S. Cl. ..... 345/204; 345/694

(58) Field of Classification Search ..... 345/36, 345/39, 45–46, 76–77, 82–84, 428, 581, 345/589–591, 593, 606, 611–613, 643–644, 345/694, 204

See application file for complete search history.

(56) References Cited

U.S. PATENT DOCUMENTS

| | | | | |
|---|---|---|---|---|
| 3,971,065 | A | 7/1976 | Bayer | |
| 4,149,152 | A * | 4/1979 | Russo | 345/593 |
| 5,113,274 | A | 5/1992 | Takahashi et al. | |
| 5,793,885 | A | 8/1998 | Kasson | |
| 5,987,169 | A | 11/1999 | Daly et al. | |
| 6,366,025 | B1 | 4/2002 | Yamada | |
| 6,486,923 | B1 * | 11/2002 | Maeshima et al. | 348/649 |
| 6,507,350 | B1 | 1/2003 | Wilson | |
| 6,771,028 | B1 | 8/2004 | Winters | |
| 6,885,380 | B1 | 4/2005 | Primerano et al. | |

(Continued)

FOREIGN PATENT DOCUMENTS

| | | |
|---|---|---|
| WO | WO03/100756 | 12/2003 |
| WO | WO 2005/052902 | 6/2005 |

OTHER PUBLICATIONS

U.S. Appl. No. 11/429,839, filed May 8, 2006; of Michael E. Miller, Michael J. Murdoch, Ronald S. Cok; titled "Color EL Display System With Improved Resolution".

(Continued)

*Primary Examiner* — Kevin M Nguyen
*Assistant Examiner* — Kenneth B Lee, Jr.
(74) *Attorney, Agent, or Firm* — Morgan, Lewis & Bockius LLP

(57) ABSTRACT

A full-color display system having improved apparent resolution comprising: a display formed from an array of full-color groups of light-emitting elements each comprising more than one luma-chroma sub-group of light-emitting elements; and a processor for receiving a full color input image signal that specifies full color image values at each of a two-dimensional number of sampled addressable spatial locations within an image to be displayed, for providing a full color image signal with image signal values corresponding to the spatial location of each luma-chroma sub-group, for computing a control signal representing the relative values, or difference between values, for the image signal values corresponding to each luma-chroma sub-group and at least one of each luma-chroma sub-group's neighbors, and for rendering a signal for driving each light-emitting element within each luma-chroma sub-group of light-emitting elements as a function of the values for the image signal corresponding to each luma-chroma sub-group and the control signal.

20 Claims, 8 Drawing Sheets

U.S. PATENT DOCUMENTS

| | | | | |
|---|---|---|---|---|
| 6,897,876 | B2 | 5/2005 | Murdoch et al. | |
| 6,919,681 | B2 | 7/2005 | Cok et al. | |
| 2002/0154152 | A1 | 10/2002 | Tezuka et al. | |
| 2004/0012605 | A1* | 1/2004 | Overton | 345/589 |
| 2004/0113875 | A1 | 6/2004 | Miller et al. | |
| 2004/0263528 | A1* | 12/2004 | Murdoch et al. | 345/600 |
| 2005/0212728 | A1 | 9/2005 | Miller et al. | |
| 2005/0225563 | A1 | 10/2005 | Brown et al. | |
| 2005/0225574 | A1 | 10/2005 | Brown et al. | |
| 2005/0225575 | A1 | 10/2005 | Brown et al. | |
| 2007/0080911 | A1* | 4/2007 | Liu et al. | 345/82 |

OTHER PUBLICATIONS

U.S. Appl. No. 11/430,065, filed May 8, 2006; of Ronald S. Cok; titled "Method And Apparatus For Defect Correction In A Display".
U.S. Appl. No. 11/429,704, filed May 8, 2006; of Michael E. Miller, Michael J. Murdoch, Ronald S. Cok; titled "Method For Rendering Color EL Display And Display Device With Improved Resolution".
U.S. Appl. No. 11/429,838, filed May 8, 2006; of Michael E. Miller, Ronald S. Cok; titled "Color Display System With Improved Apparent Resolution".

* cited by examiner

COLOR DISPLAY SYSTEM WITH IMPROVED APPARENT RESOLUTION

FIELD OF THE INVENTION

The present invention relates to full-color display systems, and more particularly, to systems employing a display with arrangements of light-emitting elements and a processor for improving the apparent resolution of such displays. In a particular embodiment for systems employing emissive displays, including electro-luminescent displays, image-processing in accordance with the invention may provide for improving the apparent resolution while reducing the power required by the display.

BACKGROUND OF THE INVENTION

Flat panel, color displays for displaying information, including images, text, and graphics are widely used. These displays may employ any number of known technologies, including liquid crystal light modulators, plasma emission, electro-luminescence (including organic light-emitting diodes), and field emission. Such displays include entertainment devices such as televisions, monitors for interacting with computers, and displays employed in hand-held electronic devices such as cell phones, game consoles, and personal digital assistants. In these displays, the resolution of the display is always a critical element in the performance and usefulness of the display. The resolution of the display specifies the quantity of information that can be usefully shown on the display and the quantity of information directly impacts the usefulness of the electronic devices that employ the display.

The term "resolution" is often used or misused to represent any number of quantities. Common misuses of the term include referring to the number of light-emitting elements or to the number of full-color groupings of light-emitting elements (typically referred to as pixels) as the "resolution" of the display. This number of light-emitting elements is more appropriately referred to as the addessability of the display. Within this document, we will use the term "addressability" to refer to the number of light-emitting elements per unit area of the display device. A more appropriate definition of resolution is to define the size of the smallest element that can be displayed with fidelity on the display. One method of measuring this quantity is to display the narrowest possible, neutral (e.g., white) horizontal or vertical line on a display and to measure the width of this line or to display an alternating array of neutral and black lines on a display and to measure the period of this alternating pattern. Note that using these definitions, as the number of light-emitting elements increases within a given display area, the addressability of the display will increase while the resolution, using this definition, generally decreases. Therefore, counter to the common use of the term "resolution", the quality of the display is generally improved as the resolution becomes finer in pitch or smaller.

The term "apparent resolution" refers to the perceived resolution of the display as viewed by the user. Although methods for measuring the physical resolution of the display device are typically designed to correlate with apparent resolution, it is important to note that this does not always occur. At least two important conditions exist under which the physical measurement of the display device does not correlate with apparent resolution. The first of these occurs when the physical resolution of the display device is small enough that the human visual system is unable to resolve changes in physical resolution (i.e., the apparent resolution of the display becomes eye-limited). The second condition occurs when the measurement of the physical resolution of the display is performed for only the luminance channel but not performed for resolution of the color information while the display actually has a different resolution within each color channel, therefore overstating the apparent resolution for the color channels.

Addressability in most flat-panel displays, especially active-matrix displays, is limited by the need to provide signal busses and electronic control elements in the display. Further in many flat panel displays, including Liquid Crystal Displays (LCDs) and bottom-emitting Electro-Luminescent (EL) displays, the electronic control elements are required to share the area that is required for light emission or transmission. In these technologies, as the area required to constitute the busses and control elements increases, the proportion of the display area that is available for actual light-emitting decreases. Depending upon the technology, reduction of the area of the light-emitting area can reduce the efficiency of light output, as is the case for LCDs, or reduce the brightness and/or lifetime of the display device, as is the case for EL displays. Regardless of whether the area required for patterning busses and control elements compete with the light-emitting area of the display, the decrease in buss and control element size that occur with increases in addressability for a given display generally require more accurate, and therefore more complex, manufacturing processes and can result in greater number of defective panels, decreasing yield rate and increasing the cost of marketable displays. Therefore, from a cost and manufacturing complexity point of view, it is generally advantageous to be able to provide a display with lower addressability. This desire is, of course, in conflict with the need to provide higher apparent resolution. Therefore, it is desirable to provide a display with relatively low addessability but high apparent resolution.

It has been known for many years that the human eye is more sensitive to spatial detail when it is presented using variations in luminance then when presented using variations in chrominance information. In the field of electronic displays, full-color displays typically employ red, green, and blue light-emitting elements. In these displays, while the red and blue light-emitting elements are necessary to form a full-color display, they often provide much less luminance than the green light-emitting elements. Therefore, it is known to employ a larger number of high-luminance green light-emitting elements than red or blue. Takashi et al. in U.S. Pat. No. 5,113,274, entitled "Matrix-type color liquid crystal display device", has proposed the use of displays having two green for every red and blue light-emitting element. Further, the introduction of additional high-luminance light-emitting elements that provide other colors of light-emission can have positive effects beyond providing higher perceived quality. For example, within the field of Organic Light Emitting Diodes (OLEDs), it is known to introduce more than three light-emitting elements where the additional light-emitting elements have higher luminance efficiency, resulting in a display having higher luminance efficiency. Such displays have been discussed by Miller et al. in U.S. Patent Application Publication 2004/0113875, entitled "Color OLED display with improved power efficiency" and in U.S. patent Application Publication 2005/0212728 also entitled "Color OLED display with improved power efficiency".

The introduction of additional high-luminance light-emitting elements has been used in a variety of ways to optimize the frequency response of imaging systems. For example, relative sensitivities of the human eye to different color channels have recently been used in the liquid crystal display (LCD) art to produce displays having subpixels with broad band emission to increase perceived resolution. For example, U.S. Patent Application 2005/0225574 and U.S. Patent Application 2005/0225575, each entitled "Novel subpixel layouts and arrangements for high brightness displays" provide various subpixel arrangements that include a high-luminance (often white or cyan) subpixel that allows more of the white light generated by the LCD backlight to be transmitted to the user than the traditional filtered RGB subpixels. The subpixel arrangements discussed include ones in which each row and each pair of columns contain all colors of subpixels, making it possible to produce a line of any color using only one row or two columns of subpixels. Therefore, if the LCD is driven correctly, it can be argued that the vertical resolution of the device is equal to the height of one row of subpixels and the horizontal resolution of the device is equal to the width of two columns of subpixels, even though it requires more subpixels than the two subpixels at the intersection of such horizontal and vertical lines to produce a full-color image. It is important to note that in arrangements of light-emitting elements such as these, there are more high-luminance light-emitting elements than there are repeating patterns of light-emitting elements that are capable of producing a full-color image. Therefore, arrangements of light-emitting elements such as these allow a luminance pattern to be displayed with a higher spatial frequency than would be possible if each luminance signal was to be rendered to each repeating pattern of light-emitting elements. However, to achieve this goal, a proper rendering algorithm must be provided to provide this higher resolution rendering without creating significant color artifacts.

Many input image signals may be used to encode and transmit a full-color image for display. For example, an input image may be described in common RGB color spaces such as sRGB or in luminance/chrominance spaces such as YUV, L*a*b*, or YIQ. In any case, the input display signal must be converted to a signal suitable for driving the native display light-emitting elements. This conversion may involve steps such as conversion of a three-color input image signal to a signal to drive an array of four or more colors of light-emitting elements as described in U.S. Pat. No. 6,897,876 issued May 24, 2005 which are capable of achieving maximum display efficiency while providing accurate color. This conversion may also comprise methods such as subpixel interpolation like those described in U.S. Patent Application 2005/0225563, entitled "Subpixel rendering filters for high brightness subpixel layouts", which allows an input image signal that is intended for display on an arrangement of subpixels to be interpolated such that the input data is more appropriately matched to an alternate arrangement of subpixels. While subpixel interpolation methods known in the art allow different spatial filtering operations to be performed on signals that are intended for display on subpixels having different colors, they do not fully allow the optimization of the signal to take advantage of the difference in the human visual system's sensitivities to luminance and chrominance information. In fact, these interpolation methods typically include a filtering process that blurs the high frequency information to render the image without significant color artifacts.

It is known in the art to perform separate processing steps on luminance than on chrominance-encoded signals. For example, U.S. Pat. No. 5,987,169, entitled "Method for improving text resolution in images with reduced chromatic bandwidth" recognizes that some compression means provide excessive blurring to high spatial frequency, high luminance chrominance information, resulting in text or other high spatial frequency image objects that appear blurred. To overcome this problem, this patent discusses reducing the chrominance signal for highly chromatic text displayed on bright (white) backgrounds.

U.S. Patent Application 2002/0154152, entitled "Display apparatus, display method and display apparatus controller" describes a display having red, green, and blue elements or subpixels which form full color pixels. This display receives an input image signal, converts the signal to a luminance and chrominance signal, then renders the luminance information to the subpixel level but renders the chrominance information to the pixel level, thus the luminance signal is represented at a higher spatial frequency than the chrominance signal, thereby providing a higher perceived resolution without visible lower frequency chromatic artifacts. It should be noted that for optimal performance the input image signal should address a number of spatial locations equal to the number of subpixels in the display device. However, because the arrangements of light-emitting elements that are discussed include only one high luminance light-emitting element per pixel and the low luminance red and blue elements provide only a low luminance signal the subpixel arrangement limits the usefulness of this approach. Further, this patent applies only linear transforms to convert from one three channel image representation to a second three-channel representation and as such can not be applied when converting an input three color signal to a four or more output color signal. Finally, the method ignores the fact that different tradeoffs between localized luminance and chrominance error may be made depending upon the spatial content of the image.

U.S. Pat. No. 6,507,350 entitled "Flat-panel display drive using sub-sampled $YC_BC_R$ color signals" also discusses encoding an input three-color RGB signal into a luminance and chrominance color space and then later rendering the signal to a three-color RGB pixel pattern. This disclosure discusses the fact that the chrominance signal can be subsampled, reducing the bandwidth required to transmit the signal without visible artifacts. Once again, because the arrangements of light-emitting elements that are discussed include only one high luminance light-emitting element per pixel and the low luminance red and blue elements provide only a low luminance signal the subpixel arrangement limits the usefulness of this approach. Further, this patent applies only linear transforms to convert from one three channel image representation to a second three-channel representation and as such can not be applied when converting an input three color signal to a four or more output color signal. Finally, the method ignores the fact that different tradeoffs between localized luminance and chrominance error may be made depending upon the spatial content of the image.

U.S. Pat. No. 5,793,885 entitled "Computationally efficient low artifact system for spatially filtering digital color images" also discusses converting an input image to a luminance and chrominance domain and then applying sharpening to only the luminance channel in the input RGB image. By applying this processing step to the luminance channel, the image may be sharpened using a single convolution to the luminance channel rather than convolving each of the red, green, and blue image signals by separate sharpening kernels. Using this approach, the efficiency of the image processing system is improved. While this process sharpens the luminance channel within the image, it does not necessarily improve the reconstruction of edge information. Further, this patent applies only linear transforms to convert from one three channel image representation to a second three-channel representation and as such can not be applied when converting an input three color signal to a four or more output color signal. Further, it does not anticipate that such a method might be significantly more beneficial when provided in a display having more high-luminance subpixels than pixels or when applied in a display system having not only red, green, and blue light-emitting elements, but also additional light-emitting elements.

There is a need, therefore, for a display system with improved apparent resolution of a display device. Particularly, such a system should provide a means of providing a higher image quality when rendering an image to an arrangement of red, green, blue, and at least one additional high luminance light-emitting element. Further, it is desirable for such a system to consider the relative efficiency of the light-emitting elements to co-optimize the efficiency of the display device.

SUMMARY OF THE INVENTION

In accordance with one embodiment, the invention is directed towards a full-color display system having improved apparent resolution comprising:

a) a display formed from a two-dimensional array of three-or-more colors of light-emitting elements, the light-emitting elements arranged in a repeating pattern to form a number of full-color groups of light-emitting elements, each full-color group of light-emitting elements comprising more than one luma-chroma sub-group of light-emitting elements, wherein the display has a peak white luminance and each luma-chroma sub-group comprises at least one distinct high-luminance light-emitting element having a peak output luminance value that is 40 percent or greater of the peak white luminance of the display device; and b) a processor for receiving a full color input image signal that specifies full color image values at each of a two-dimensional number of sampled addressable spatial locations within an image to be displayed, for providing a full color image signal with image signal values corresponding to the spatial location of each luma-chroma sub-group, for computing a control signal representing the relative values, or difference between values, for the image signal values corresponding to each luma-chroma sub-group and at least one of each luma-chroma sub-group's neighbors, and for rendering a signal for driving each light-emitting element within each luma-chroma sub-group of light-emitting elements as a function of the values for the image signal corresponding to each luma-chroma sub-group and the control signal.

ADVANTAGES

The advantages of various embodiments of this invention include providing a full color display system with improved apparent resolution and power consumption.

DETAILED DESCRIPTION OF THE INVENTION

Figure 1:
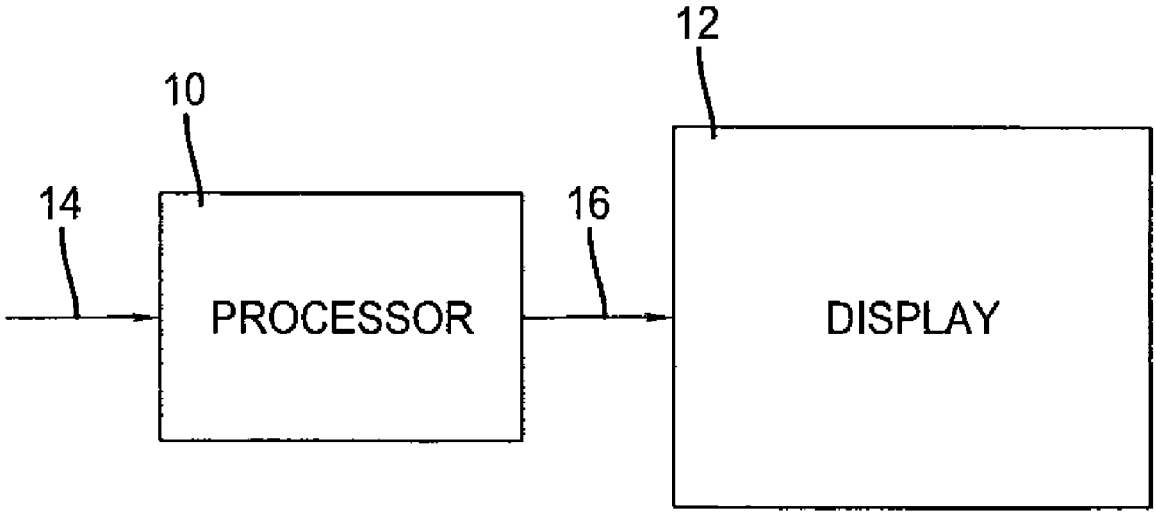
FIG. 1 is a schematic diagram showing the components of the display system.
Figure 2:
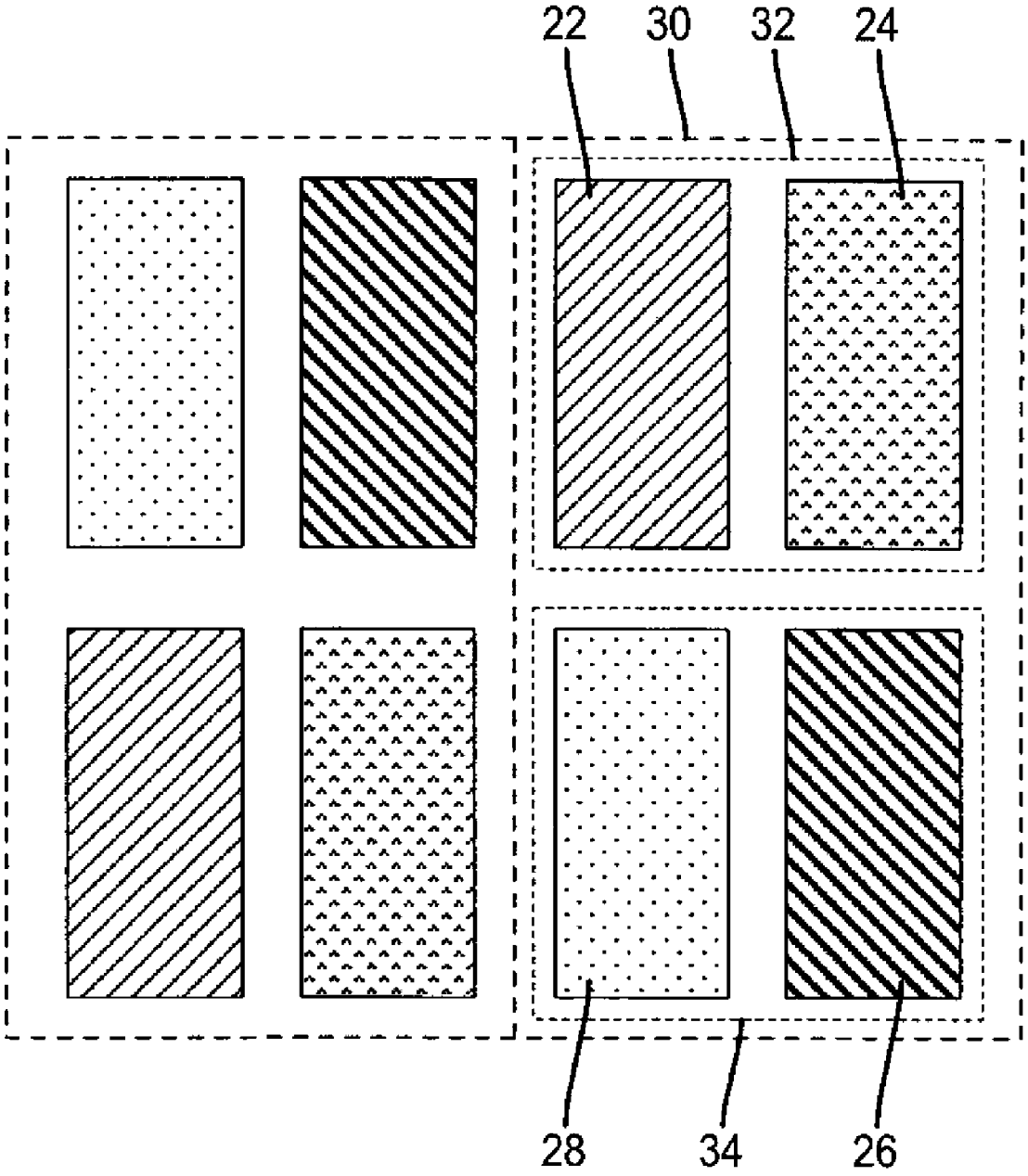
FIG. 2 a schematic diagram showing an arrangement of light-emitting elements in pixels of a display according to an embodiment of the present invention.

A full-color display system comprised of a processor 10 and a display 12 as shown in FIG. 1 enables a higher apparent resolution than comparable displays having the same number of light-emitting elements per area. The display 12 is formed from a two-dimensional array of three-or-more colors of light-emitting elements in which the light-emitting elements are arranged in a repeating pattern to form a number of full color groups of light-emitting elements. One embodiment of such a two-dimensional array of three-or-more colors of light-emitting elements is depicted in FIG. 2. As depicted in this figure, each of the full-color groups of light-emitting elements 30 are comprised of more than one luma-chroma sub-group 32, 34 of light-emitting elements 22, 24, 26, 28. Each luma-chroma sub-group 32, 34 is comprised of at least one distinct high-luminance light-emitting element 24, 28 having a peak output luminance value that is 40 percent or greater of the peak white luminance of the display device.

Figure 3:
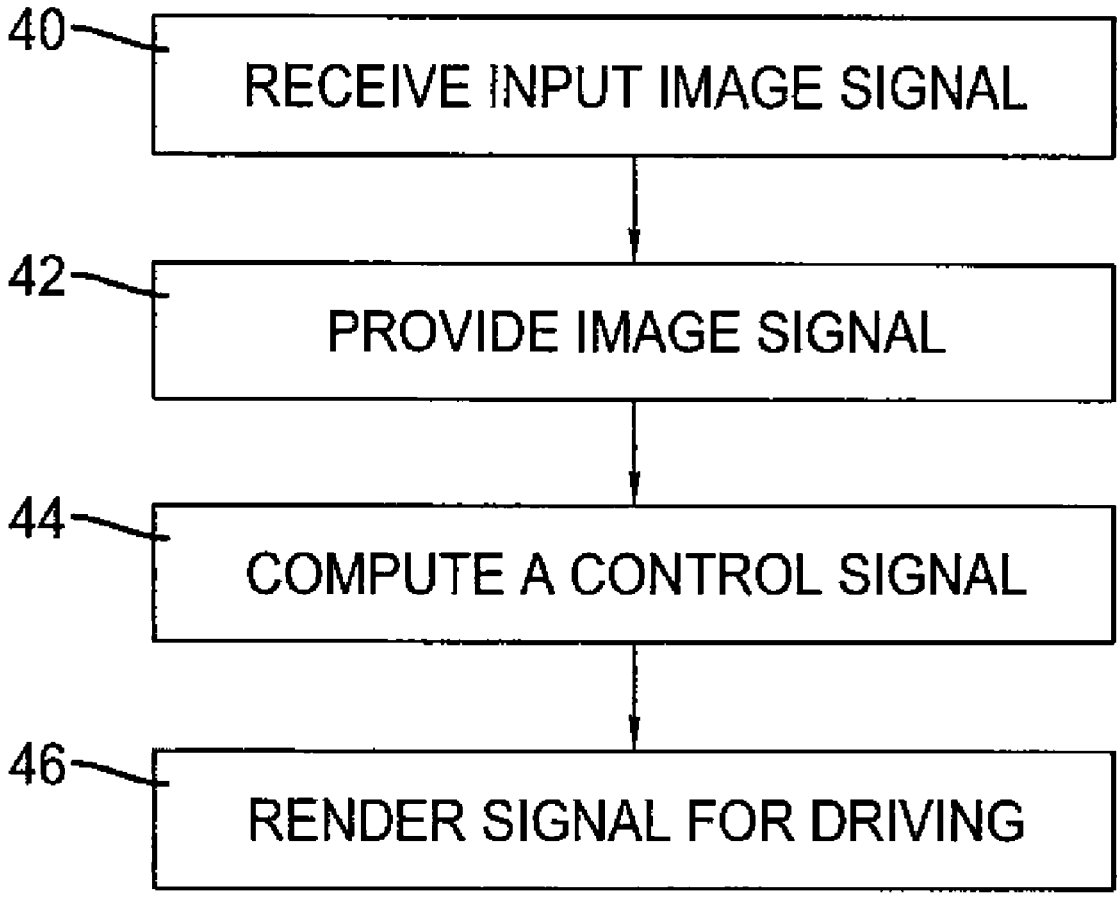
FIG. 3 is a flow diagram depicting image processing steps performed in an embodiment of the present invention.

The processor 10, in FIG. 1 provides a signal 16 to drive the light-emitting elements of the display 12 by executing the image-processing shown in FIG. 3. As shown in FIG. 3, the processor receives 40 a full (three-or-more) color input image signal 14 that specifies full color image values at each of a two-dimensional number of sampled addressable spatial locations within an image to be displayed. In preferred embodiments of the invention, the number of sampled addressable locations represented within the three-or-more color input image signal 14 will be equal to or greater than the number luma-chroma sub-groups 32, 34 in the display array to maximize the increase in apparent resolution. However, even if the number of sampled addressable locations is smaller than the number of luma-chroma sub-groups 32, 34, some apparent resolution benefit may be obtained as compared to the prior art as long as the number of sampled addressable locations is larger than the number of full color groups of light-emitting elements. The processor 10 will then provide 42 a full color image signal with image signal values corresponding to the spatial location of each luma-chroma sub-group. If the number of sampled addressable locations within the input image signal 14 is equal to the number of luma-chroma sub-groups of light emitting elements, this signal may be the same signal that is received 40. If the number of sampled addressable locations within the input image signal 14 is not equal to the number of luma-chroma sub-groups of light emitting elements, the input image signal 14 may be re-sampled using techniques as known in the art to provide a full color image signal with image signal values wherein the full color image signal has a sampled addressable location that corresponds to each luma-chroma sub-group of light-emitting elements. The processor 10 will then compute 44 a control signal representing the relative values, or difference between values, for the image signal values corresponding to each luma-chroma sub-group and at least one of each luma-chroma sub-group's neighbors. Finally, the processor will render 46 a signal for driving each light-emitting element within each luma-chroma sub-group of light-emitting elements as a function of the values for the image signal corresponding to each luma-chroma sub-group and the control signal.

Within this invention, it is important to clearly define and differentiate the terms "pixel", "logical pixel" and "luma-chroma sub-group". Within this invention, a "pixel" refers to the smallest repeating group of light-emitting elements capable of providing the full range of colors the display is capable of producing. That is, each full-color repeating pattern 30 of light-emitting elements form a "pixel" within the display. A "luma-chroma sub-group" is comprised of a sub-group of one or more light-emitting elements of a pixel, each sub-group including at least one distinct (i.e., not shared with another luma-chroma sub-group) high luminance light-emitting element 24, 28. The "luma-chroma sub-groups" 32, 34 may, and typically will, be additionally comprised of one or more additional lower luminance light-emitting elements 22, 26. Within this definition, a high-luminance light-emitting element is a light-emitting element that has a peak output luminance value that is 40 percent or greater of the peak white luminance of the display device while a low-luminance light-emitting element will have a peak output luminance value that is less than 40 percent of the peak white luminance of the display device. The peak white luminance of the display is the luminance that results when the maximum input image signal values are input. That is, within a display system having a typical 8 bit per channel RGB input, the peak white display luminance will occur when the input image signal values are 255 for each of the red, green, and blue inputs.

Within a display comprised of at least red, green, and blue light-emitting elements, the red and blue light-emitting elements will typically be lower luminance light-emitting elements 22, 26 while the green light-emitting element will be a high luminance light-emitting element 24, 28. In displays further comprised of broadband or multi-band light-emitting elements, such as white, yellow, or cyan these broadband or multi-band light-emitting elements will typically be classified as high-luminance light-emitting elements 24, 28. The term "logical pixel" refers to a representation of a spatial location represented within the three-or-more color input image signal 14. In a typical three-color input image signal, a logical pixel will comprise a red, green, and blue value for each logical location within the image that is represented by the three-or-more color input image signal 14. Therefore, the three or more color input image signal will have as many logical pixels as addressable spatial locations.

To create clarity we will further define the terms "complimentary luma-chroma sub-groups" and "similar luma-chroma sub-groups" for specific display embodiments having two types of luma-chroma sub-groups, each luma-chroma sub-group containing different combinations of light-emitting elements. In such a display, relative to a selected luma-chroma sub-group, a "complimentary luma-chroma sub-group" is composed of a different combination of colors of light-emitting elements than the combination of colors of light-emitting elements within the selected luma-chroma sub-group. "Similar luma-chroma sub-groups", on the other hand, contain the same colors of light-emitting elements relative to a selected luma-chroma sub-group.

Within one embodiment of the present invention, the full-color display 12 is formed from an array of three colors of light-emitting elements in which the light-emitting elements are arranged in a repeating pattern to form a number of full-color groups of red, green, and blue light-emitting elements, wherein each luma-chroma sub-group comprises a green light-emitting element and either a red or blue light emitting element, wherein the green light-emitting elements are high-luminance light-emitting elements. Such an embodiment is depicted in the portion of an electro-luminescent (EL) display shown in FIG. 4. Within this display, each full-color repeating group of light-emitting elements thus comprises at least two green light-emitting elements 54, 58, 74, 78 for each red 52, 76 or blue 56, 72 light-emitting element.

Figure 4:
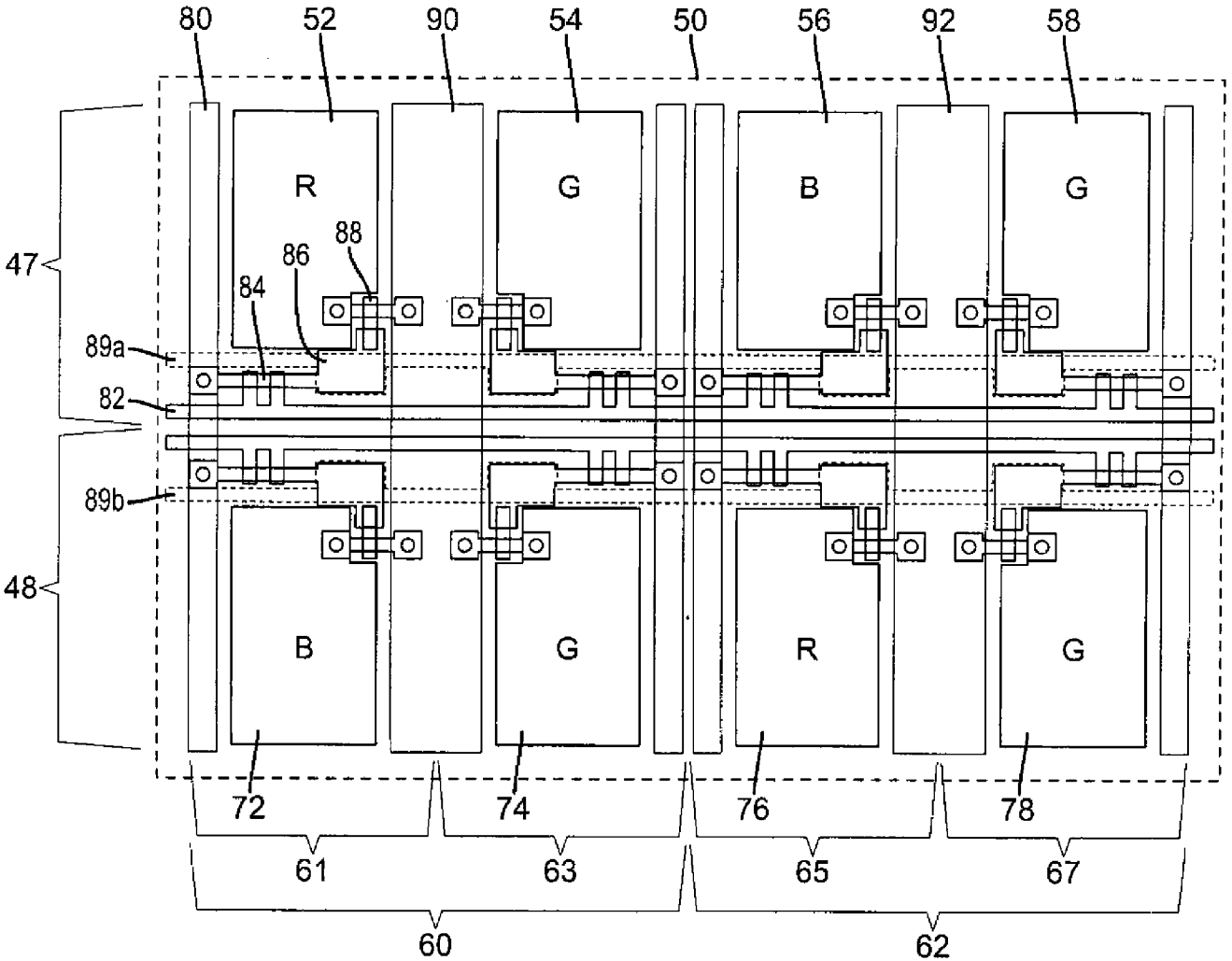
FIG. 4 is a schematic diagram showing a portion of an EL display comprised of red, green and blue light-emitting elements in neighboring pixels according to an embodiment of the present invention.

Although many of the inventive concepts provided within this disclosure may be applied in practically a display employing practically any technology having more than one luma-chroma sub-group of light-emitting elements for each full-color repeating pattern of light-emitting elements, certain aspects of this disclosure may be advantageously employed to overcoming design limitations particularly within emissive displays, and more particularly electro-luminescent (EL) displays, including displays formed from organic light-emitting diodes (OLEDs), as described, e.g., by U.S. Pat. No. 4,476,292 and Polymer OLEDs as described in U.S. Pat. No. 5,247,190, which are hereby included by reference. FIG. 4 shows one layout of an EL display useful in practicing the inventive concepts that are targeted to this technology. A portion 50 of a display is comprised of red, green, and blue light-emitting elements, wherein the green light-emitting elements are high-luminance light-emitting elements. Each row of light-emitting elements, i.e., 47 and 48 of this display device is comprised of all colors of light-emitting elements. For example, the first row 47 of the portion of the display substrate 50 contains red 52, green 54, 58, and blue 56 light-emitting elements. Additionally, each pair 60 and 62 of columns 61, 63, 65, 67 of light-emitting elements is also comprised of all colors of light-emitting elements. For example, the first pair 60 of columns 61, 63 of light-emitting elements is comprised of green 52, 74, red 54, and blue 72 light-emitting elements. Also shown in FIG. 4 each light-emitting element is driven by an active-matrix circuit, including a select line 82, a data line 80, a select transistor 84, a capacitor 86, a power transistor 88, a power line buss 90, 92 and a capacitor line 89*a*, 89*b*. In this display device, a signal is provided on the select line 82, allowing a drive voltage provided on the data line 80 to charge the capacitor 86. When this capacitor is charged, the power transistor 88 allows current to flow from the power line 90 to a first electrode (not shown), which lies under the light-emitting element 52. The current flows from this electrode through the electro-luminescent material used to form the light-emitting element and to a second electrode above the light-emitting element (also not shown). As shown in this figure, the light-emitting elements in each pair of columns share a common buss. For example, the light-emitting elements (52, 54, 72, and 74) in the first pair 60 of columns, share a common buss 90. Further, the light-emitting elements (56, 58, 76, and 78) in a neighboring pair 62 of columns 65, 67, share a separate, common buss 92.

While FIG. 4 provides a specific configuration of active-matrix drive circuitry, several variations of conventional circuits can also be applied to the present invention by those skilled in the art. In EL display design it is important to minimize the size of the electronic elements to increase the light-emitting area or to provide further design flexibility. The minimum functional size of the capacitor 86 and power transistor 88, however, is dependent upon the current that is required to drive any individual light-emitting element, and the minimum size of the buss 90 is directly related to the peak current that must be provided to a row or column to which the buss provides power. Current is directly related to light output and therefore high currents are generally required to produce displays having a high luminance output and therefore high apparent brightness. Further, lifetime of the materials are dependent upon current density and therefore, lifetime is reduced when the display is driven to high luminance and when the electronics occupy a large proportion of the pixel, e.g., in a bottom-emitting EL display where the electronics and the emissive material must share the same area. The circumstances are somewhat better in top-emitting displays as the emitting materials and electronics occupy separate planes, allowing the EL material to emit over a large portion of the pixel even when the electronics are large. Note that within the configuration shown in FIG. 4, each luma-chroma sub-group and additionally each full-color group of light-emitting elements share a common power buss. Through sharing this buss, the area required for bussing is reduced since it is not necessary to allocate space between separate buss lines to enable photo-lithographic or other manufacturing processes that may be used to create separate buss lines. Therefore, by sharing a common buss line, it is possible to make the buss lines wider for an allocated space on the display substrate, increasing the range of luminances that the display is capable of producing without artifacts.

It should be noted that the light-emitting area of each of the light-emitting elements shown in FIG. 4 are approximately equal. However, in most display technologies, it will be desirable for the overall area of each color of light-emitting elements to be more equal. That is, if each full-color group of light-emitting elements is comprised of twice as many green light-emitting elements 54, 58, 74, 78 as red 52, 76 and blue 56, 72 light-emitting elements, the light-emitting area of the red 52, 76 and blue 56, 72 light-emitting elements may desirably need to be twice the light-emitting area of the green light-emitting elements 54, 58, 74, 78 in order to balance the color output and/or the lifetime of the light output by the display.

Also, because the light-emitting elements in FIG. 4 are arranged in a repeating pattern to form a number of full-color groups of light-emitting elements, each full-color group of light-emitting elements comprising more than one luma-chroma sub-group of light-emitting elements, and because the display is composed of two types of luma-chroma sub-groups, namely those employing red 52 and green 54 light-emitting elements, and those employing blue 72 and green 74 light-emitting elements, the luma-chroma sub-groups directly above, below, to the right and to the left of a given luma-chroma group which employs either a red 52 or blue 74 light-emitting element employ the complimentary red or blue light-emitting elements. Therefore, a full-color image may be created by employing any luma-chroma sub-group together with light-emitting elements in neighboring, complimentary luma-chroma sub-groups to the right, left, above or below the luma-chroma sub-group. To render a three-or-more color signal for driving the full-color two-dimensional groups of light-emitting elements, the processor 10 may perform a set of detailed steps such as those shown in FIG. 5.

Figure 5:
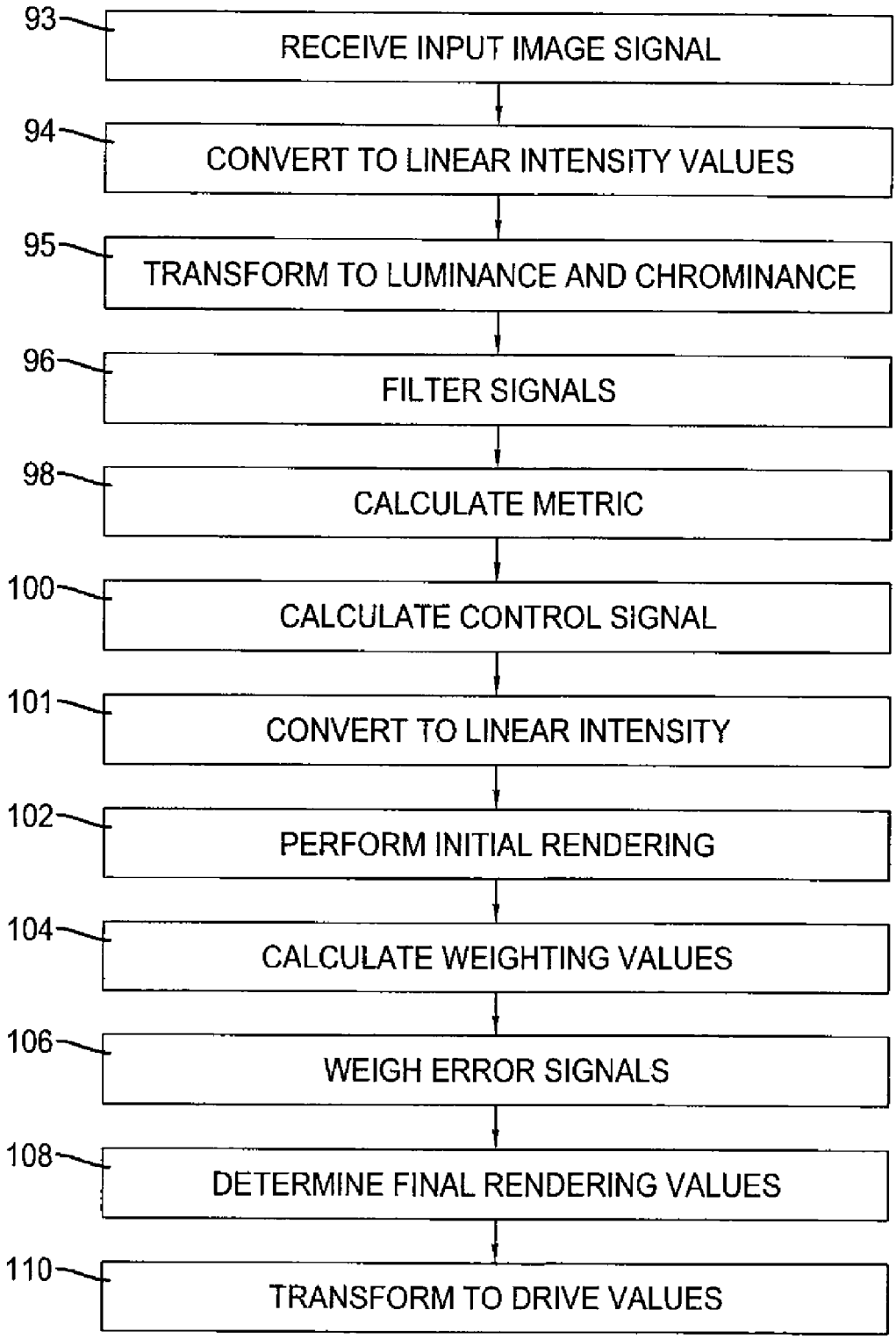
FIG. 5 is a flow diagram depicting detailed image processing steps that may be performed in an embodiment of the present invention.

As shown in FIG. 5, the processor of the present invention will perform a process that begins with receiving 93 a full color input image signal. This full color input image signal 14 may be encoded in any number of known input color spaces, including sRGB or $YC_rC_b$. The input image signal values may then converted 94 to linear intensity RGB values using means known in the art, such as transforming the input values through a non-linear look-up table. Assuming that the full color input image signal that specifies full color image values at each of a two-dimensional number of sampled addressable spatial locations is equal to the number of luma-chroma sub-groups and that the spatial locations represented within the full-color image correspond to the spatial locations of the luma-chroma sub-groups, the full color input image signal will be provided for subsequent processing. Therefore, step 93 in FIG. 5, corresponds to steps 40 and 42 within FIG. 3.

The linear intensity RGB values may then be transformed 95 into values that are expressed within a luminance and chrominance space. For a three-color input image signal expressed in the sRGB color space, the transformation will typically include a color rotation that may be applied, for example, by applying the matrix:

$$\begin{bmatrix} 0.299 & 0.587 & 0.114 \\ -0.299 & -0.587 & 0.886 \\ 0.701 & -0.587 & -0.114 \end{bmatrix}$$

to each of the input linearized sRGB values. Through this transformation, the values may be represented in a desirable luminance and chrominance color space. It is important to note a few characteristics of this color space. First of all, the luminance channel is formed from a weighted average of the red, green and blue values as indicated by the weighting values shown in the first row of the matrix. Second, the first color channel ($C_1$) generally represents blue minus yellow as indicated by the weighting values in the second row of this matrix. Therefore, $C_1$ values will generally be positive when the color contains more blue than red and green (or yellow) content but will be negative when the color contains more red and green (yellow) content and less blue. Finally, the second color channel ($C_2$) generally represents red minus cyan and therefore will be positive for colors having a large red but small green and blue content and will be negative for values having large values in the green and blue color channels but small values in the red channel. Further, highly saturated colors will have large absolute $C_1$ and $C_2$ values while neutral colors will generally have lower absolute $C_1$ and $C_2$ values. Therefore, reducing the magnitude of the chrominance values will tend to reduce the saturation of colors represented by the signal. If a spatial averaging or low pass filtering is performed for the chrominance channels, the chrominance values will be reduced for spatial locations that represent high spatial frequencies within the chrominance image. That is, the chrominance values will be reduced for edges within chrominance channels.

The luminance or chrominance values may then be filtered 96. This filtering operation may include blurring one or more of the chrominance signals. This processing step reduces the color saturation along edges between differently colored areas. Because the human visual system is much less sensitive to high spatial frequency chrominance information than to high spatial frequency luminance information, the chrominance signal can be blurred substantially without producing any visible perceived color artifacts. However, by blurring the chrominance signal, the color saturation is reduced along edge regions, allowing more colors of light-emitting elements within a display having three colors of light-emitting elements to be employed when rendering edge information. Therefore, edges can be rendered with higher perceived resolution after the chrominance channels are blurred. This filtering process may also include sharpening the luminance signal as discussed in U.S. Pat. No. 5,793,885 to create an image that is sharper in appearance. By sharpening the luminance channel the spatial information within each color represented in the three-or-more color input image signal in a three-channel display may be sharpened through a single convolution rather than through the application of multiple convolutions.

A metric may then be calculated 98 for the input signal corresponding to the spatial location of each luma-chroma sub-group of light-emitting elements. The metric ideally correlates with the perception of luminance and chrominance represented by the input image signal values. An appropriate metric is the luminance value itself. More complex metrics may include color metrics, such as L*a*b* or Yu'v'.

The control signal is then calculated 100 to guide further rendering. The steps 94 through 100 are therefore steps that are performed to calculate the control signal as discussed as step 44 within FIG. 3. This control signal may be computed as a function of the difference between the metric value for the spatial location corresponding to each luma-chroma sub-group of light-emitting elements and the metric value for the spatial location corresponding to at least one of the neighboring luma-chroma sub-groups of light-emitting elements. Although the control signal may be computed as a difference value, it may also be computed as a function of the ratio between the metric value for the spatial location corresponding to each luma-chroma sub-group of light-emitting elements and the metric value for the spatial location corresponding to at least one of the neighboring luma-chroma sub-groups of light-emitting elements. Ideally, this difference or ratio will be computed between each luma-chroma sub-group of light-emitting elements and the metric value for each of the neighboring, complimentary luma-chroma sub-groups of light-emitting elements. In one embodiment, the control signal may be calculated as the difference between the metric value for each luma-chroma sub-group of light emitting elements and the metric value for each neighboring, complimentary luma-chroma sub-groups of light-emitting elements. These control signal difference values are then recorded.

The filtered luminance and chrominance values may then be converted 101 to linear intensity values that are normalized to the display primaries. This will typically be done by employing a 3×3 matrix to rotate the information from the luminance and chrominance space to the color space defined by the color of the light-emitting elements of the display.

An initial rendering of the input three or more color input image signal to the three-or-more image signal for driving the light-emitting elements is performed 102. Within this step, the signal values are rendered to the arrangement of light-emitting elements, initially rendering the red, green and blue signals determined in step 101 for each spatial location corresponding to each luma-chroma sub-group. Note, however, that within this example, each luma-chroma sub-group of light-emitting elements has only a red or a blue light-emitting element. Therefore, there is either a red or a blue linear intensity value that cannot be assigned to light-emitting elements within each luma-chroma sub-group. These unassigned red or blue signals are recorded as "error signals" for each luma-chroma sub-group of light-emitting elements.

To render a signal for driving the display as a function of the control signal and the input image signal, weighting values may be calculated or assigned 104 based on the control signal values. It should be noted that in this embodiment, the purpose of the weighting values is to determine the proportion of the "error signal" that is intended to be rendered with the color of light-emitting element that is not present within each luma-chroma sub-group of light-emitting elements and that is to be rendered by each of the neighboring, complimentary luma-chroma sub-groups of light emitting elements. Having the difference values from the previous step, the spatial location of the neighboring, complimentary sub-group of light-emitting elements having the minimum difference is determined. In a specific example, the spatial location having the minimum difference is assigned a weighting of 1, indicating that all of relevant blue light will be transferred to the neighboring complimentary luma-chroma sub-group of light emitting elements having the smallest difference. In other embodiments, the weighting factors may be determined by calculating different weighting values for more than one of the neighboring complimentary luma-chroma sub-groups of light-emitting elements. In one embodiment, the larger and smaller metric values for the spatial location corresponding to each luma-chroma subgroup and the metric for each of the spatial locations corresponding to each neighboring, complimentary luma-chroma subgroup is determined. The ratio of the smaller number to the larger number is computed for the locations corresponding to each pair, these individual values are then normalized by their sum to provide final weightings. Such a method for computing weighting values allows neighboring elements with smaller differences in metric value to receive higher weightings than those with larger differences.

The error signal for each luma-chroma subgroup is then weighed 106 by multiplying the error signal by the weighting values for the complimentary luma-chroma sub-groups to create final error correction signals. The final rendering values are then determined 108 by adding the final error correction signal to the initial rendering values for the appropriately colored light-emitting element within each neighboring, complimentary luma-chroma sub-group. Note that when this is completed, the rendering values for the light-emitting elements that appear least frequently in the matrix are twice the values that would be used to drive the green channel. Depending upon display calibration and data handling path design, this may be fine but in most traditional systems, the resulting rendering values for the spatial locations corresponding to the light-emitting elements that appear least frequently in the matrix are then divided by 2. Also note that it is possible for these values to exceed 1 even after this division is performed. This condition may be handled in several ways, including simply clipping the value, analyzing the rendering values corresponding to neighbor luma-chroma sub-groups and re-allocating the signal to neighbors capable of rendering the additional luminance or determining the luminance error that would result if the values were clipped and re-allocating at least a portion of this luminance to the other light-emitting element within the luma-chroma sub-group.

The rendering values are then transformed 110 to drive values. Typically this transformation will require the mapping of values through a non-linear look-up-table to correct for the display luminance response curve. As discussed, steps 101 through 110 are performed to render a signal for driving the display as a function of the control signal and the input image signal.

Figure 6:
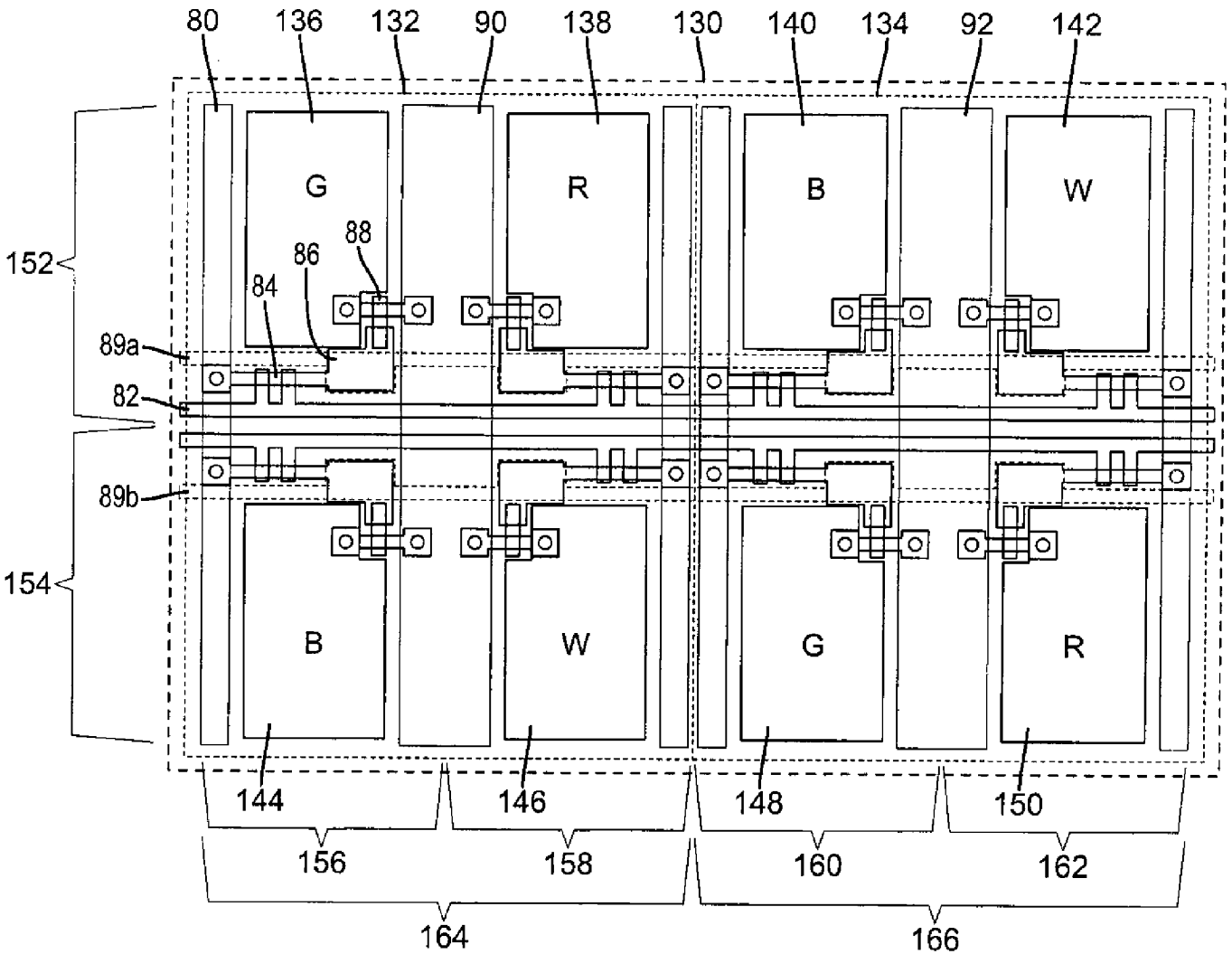
FIG. 6 is a schematic diagram showing a portion of an EL display comprised of red, green, blue and white light-emitting elements in neighboring pixels according to an alternative embodiment of the present invention.

Although, the present invention may be employed for displays having three colors of light-emitting elements, with further modification, it may alternatively be applied in displays having four-or-more colors of light-emitting elements. FIG. 6 depicts a portion of an EL display 130 that may be employed within such an embodiment. Note that this portion of the EL display 130 is comprised of two full-color groups of light-emitting elements 132, 134, each of which is comprised of four colors of light-emitting elements which are arranged within a two-dimensional array of rows 152, 154 and columns 156, 158, 160, 162. Alternate embodiments of displays useful in practicing the present invention may be comprised of more than four colors of light-emitting elements. Within this particular embodiment, the four colors of light-emitting elements within each full-color group of light-emitting elements 132, 134 comprise a red 138, 150, green 136 148, blue 144, 140 and at least one additional light-emitting element 146, 142. The additional light emitting elements 146, 142 are preferably high-luminance light-emitting elements. For this particular example, this additional light-emitting element will be assumed to emit white light but other useful high-luminance light-emitting elements may include ones which emit cyan, yellow or a different color of green light than the green light emitting elements 136, 148. For emissive displays, such as EL displays, the at least one additional colored light-emitting element preferably has a higher luminance efficiency than the red, green, or blue light-emitting elements, providing the potential for rendering images to create a higher energy efficiency. In displays employing red 138, 150, green 136, 148, and blue 144, 140 light-emitting elements in addition to such an additional high-luminance light-emitting element 146,142; the green 136,148 and the additional 146,142 light-emitting elements will typically be high-luminance elements, providing a display in which each full-color group of light-emitting elements 132,134 is composed of more than one luma-chroma sub-group of light-emitting elements. For example, within the display configuration shown in FIG. 6, the first full-color group of light-emitting elements 132 may be composed of a first luma-chroma sub-group located within the intersection of row 152 and the pair 164 of columns 156 and 158 comprised of a green 136 and red 138 light-emitting element and a second luma-chroma sub-group located within the intersection of row 154 and the pair 164 of columns 156 and 158 comprised of a blue 144 and the additional light-emitting element 146. The second full-color group of light-emitting elements 134 shown in FIG. 6 may be composed of a first luma-chroma sub-group located at the intersection of row 154 and the pair 166 of columns 160 and 162 comprised of a green 148 and red 150 light-emitting element and a second luma-chroma sub-group located at the intersection of row 152 and the pair 166 of columns 160 and 162 comprised of a blue 140 and the additional light-emitting element 142. Note that as defined the first and second luma-chroma sub-groups as described are complimentary luma-chroma sub-groups while the two first and the two second luma-chroma sub-groups are similar luma-chroma subgroups.

The display portion 130 of FIG. 6 has some additionally notable, although not required, properties. Specifically, the light-emitting elements include equal numbers of white (146, 142), red (138, 150), green (136, 148), and blue (144, 140) light-emitting elements and the light-emitting elements are formed in two-by-two arrays having diagonally opposed high-luminance green and white light-emitting elements. This arrangement results in maximum spatial separation of the high-luminance light-emitting elements within the array of light-emitting elements, providing the potential of creating images with higher perceived luminance uniformity than alternative arrangements in which the white (146, 142) and green (136, 148) are arranged in individual rows or columns. Further the display portion 130 shown in FIG. 6 is formed from pairs of luma-chroma sub-groups wherein the relative positions of the complimentary luma-chroma sub-groups are exchanged in neighboring full-color groups in one dimension. For example, as shown in FIG. 6, while the first luma-chroma sub-group, which is composed of green (136) and red (138) light-emitting elements is in row 152 within the first full-color group of light-emitting elements 132, the first luma-chroma sub-group, which is composed of green 148 and red 150 light emitting elements, appears in row 154 in the neighboring full-color group of light-emitting elements 134, and the first and second luma-chroma sub-groups are interchanged across each row. By performing such an interchange, each row of light-emitting elements shown in FIG. 6 may contain all colors of light-emitting elements and therefore, a full color line may be presented with any single row of light-emitting elements. The fact that the locations of these luma-chroma sub-groups are interchanged across each row allows the display shown in FIG. 6 to present any individual colored line with the vertical resolution of one row 152, 154 and a horizontal resolution equal to one pair 164, 150 of columns of light-emitting elements. It is further significant that each luma-chroma sub-group is substantially square, allowing the horizontal and vertical resolution of the display to be substantially equal.

Having a display, such as the one shown in FIG. 6, it is then necessary to employ a processor for providing a signal to drive it wherein the processor receives a three-or-more color input image signal that specifies three-or-more color image values at each of a two-dimensional number of sampled addressable spatial locations within an image to be displayed and provides a four-or-more color signal for driving the full-color two-dimensional groups of four-or-more light-emitting elements. As was the case for the processor for the three-color display, the processor will compute a control signal representing the relative values, or difference between values, for the input signal corresponding to each luma-chroma sub-group and relative values, or difference between values, for at least one of the luma-chroma sub-group's neighbors, and will render a signal for driving each light-emitting element within each luma-chroma sub-group of light-emitting elements as a function of the values for the input signal corresponding to each luma-chroma sub-group and the control signal for the luma-chroma subgroup or one of its neighbors. However, it is additionally necessary for the processor to convert the three-or-more color input image signal to a four-or-more color signal for driving the four-or-more colors of light-emitting elements within the display. This additional conversion may be accomplished by applying one of a number of methods.

One method for driving the display as shown in FIG. 6 is to employ a method similar to the one shown in FIG. 5. As discussed previously, this method may be comprised of steps including: receiving 93 the three-or-more input image signal, converting 94 the input image signal to linear intensity values, transforming 95 the linear intensity values to luminance and chrominance values, filtering 96 the luminance or chrominance values, calculating 98 a metric and calculating 100 a control signal. Each of these steps may be performed identically, as shown in FIG. 5, regardless of whether the display has three colors of light-emitting elements or four-or-more colors of light-emitting elements.

In a display system comprised of a display having four-or-more light-emitting elements, the step of converting to linear intensity display primaries 101 must additionally be comprised of converting the luminance and chrominance signal to a four-or-more color output image signal. One method for performing this step is to perform a color rotation the luminance and chrominance representation to RGB primaries that might be the RGB primaries of the display. This will typically be done through the application of a 3×3 matrix to perform the color rotation. Once the color is rotated to this RGB space, color conversion methods such as described in U.S. Pat. No. 6,885,380, entitled "Method for transforming three colors input signals to four or more output signals for a color display", or within commonly assigned, concurrently filed, application U.S. Ser. No. 11/429,839, by Miller, et al, the disclosures of which are hereby incorporated herein in their entirety by reference, may be applied to convert from the RGB color space to a signal for driving the four-or-more light-emitting elements of the display. Such methods for RGBW displays often involve determining the neutral luminance at each spatial location represented in the three-or-more color input image signal and adding at least a portion of this luminance to the white channel, while possibly subtracting a portion of this luminance from the RGB channels. Conversion algorithms for displays having additional high-luminance light-emitting elements that are not white in color often employ methods where the amount of luminance that may be produced by the additional colored light-emitting element to form the color represented by the three-or-more color input image signal is determined and a portion of this luminance is subtracted from the RGB signal and added to the signal for the additional light-emitting element.

Once the values have been converted 101 to display primary normalized linear intensity values, the same steps shown in FIG. 5 may be employed, including: performing 102 an initial rendering of these values to the luma-chroma sub-groups of light-emitting elements, calculating 104 weighting values, weighting 106 the error signals, determining 108 the final rendering values, and transforming 110 the final rendering values to drive values. Note, however, that some detailed differences in these processes will exist, the primary difference being that there will be two "error signals" for each luma-chroma subgroup as there are two colors of light-emitting elements that are not present within each of the luma-chroma sub-groups of light-emitting elements as shown in FIG. 4. The error signal for each missing color in each luma-chroma subgroup is accordingly weighed 106 by multiplying the error signal by the weighting values for the complimentary luma-chroma sub-groups to create final error correction signals. The final rendering values are then determined 108 by adding the final error correction signals to the initial rendering values for the appropriately colored light-emitting elements within each neighboring, complimentary luma-chroma sub-group.

It should be noted, however, that when one applies the process as just described, some unexpected behaviors result. As an example, by blurring the chrominance channels in a system employing red, green, and blue light-emitting elements and rendering as described, the rendering of edge information is always improved as all of the red, green, and blue light-emitting elements are employed to render high-frequency spatial content within the three color input image signal since these edges are not fully saturated as discussed earlier. However, in the example provided for a display having more than three colors of light-emitting elements, if all of the neutral luminance is subtracted from the red, green, and blue image signal values during the conversion from a three color signal to the four-or-more color linear intensity signal, then the white light-emitting element will be employed almost exclusively when presenting high spatial-frequency content as it will be used to render the less saturated edge information, and the use of only one color of the light-emitting element will defeat the purpose of blurring the chrominance channels and degrade the rendering of edge information. Therefore, it is useful to further improve the method as just described when chrominance channels are blurred.

To improve this method, it is first important to understand that any desired color at a spatial location within the full color input image signal or within the luminance and chrominance representation may be formed from multiple combinations of four-or-more color signals for driving the four-or-more colors of light-emitting elements. For example, for the portion of the display shown in FIG. 6 which has red, green, blue, and white light-emitting elements, a color to be formed by the display (as may be specified by luminance and chrominance values) may be formed from either a combination of light emitted by the red, green, and blue light-emitting elements or by the combination of light emitted by the combination of the white light-emitting element in combination with the light emitted by two or fewer of the red, green, and blue light-emitting elements. That is, the color to be formed may be formed by one of two triads of the four light-emitting elements. For colors that are very near white, forming the color by applying the red, green, and blue light-emitting elements will require that the majority of the luminance be supplied by the green light-emitting element while forming this color by applying the white and two or fewer of the red, green, and blue light-emitting elements will require that the vast majority of the luminance be supplied by the white light-emitting element. To control the proportion of the luminance that is to be created by each of these combinations of light-emitting elements, triad mixing ratio values may be used. For instance, in a conversion algorithm that consists of determining the minimum of the red, green and blue intensity values, determining a portion of this minimum value to subtract from the red, green, and blue relative intensity values and using this portion to form the white intensity value, the triad mixing ratio value may be defined by the ratio of the portion of the minimum value that is subtracted from the minimum value divided by the minimum value, or stated another way, the portion of the minimum value to be subtracted may be computed by multiplying the minimum value by a desired triad mixing ratio value.

For example, it is possible to perform the calculation for transforming the full color image input signal to a four-or-more color signal for driving once for each full color group of light-emitting elements. The display primary normalized linear intensity values may be averaged within each full-color group of light-emitting elements, thereby blurring the chrominance channels of the image input signal for the complimentary sub-groups of a full color group of light-emitting elements. The control signal may then be calculated by computing the relative values, or difference between the metric values for the spatial locations corresponding to each luma-chroma sub-group within each full color group of light-emitting elements. The control signal may then be used to determine the triad mixing ratio for the light-emitting elements of two complementary sub-groups in a full-color group of light-emitting elements, and this triad mixing ratio may be used in the conversion from the averaged linear intensity values within each full color group of light-emitting elements. For example, when the difference in metric value is large between complementary sub-groups, the triad mixing ratio may be adjusted to nearly 0 or 1.0, such that the luma-chroma sub-group corresponding to the spatial location having the higher metric value (e.g., representing the higher luminance side of an edge) provides a higher proportion of the luminance in the full-color group. Notice that in this case, the process may be further simplified as the resulting four-or-more color signals may be used to directly drive the light-emitting elements within the full color group of light emitting elements. By applying the control signal in the color conversion, a rendering is provided that is higher in spatial resolution than the size of the full color groups of light-emitting elements after transforming 110 the rendering values to drive values as described earlier. Therefore, by directly controlling proportion of the luminance that is to be created by each of these combinations of light-emitting elements, the spatial resolution of the display and therefore the rendering of edge information may be further improved.

When the display is an emissive display having four-or-more colors of light-emitting elements which are comprised of a red, a green, a blue, and at least one additional high-luminance light-emitting element, it is likely that the additional light-emitting element will have a higher luminance efficiency than the red and blue light-emitting elements. Further, when the display utilizes color filters as a component of the red, green, and blue light-emitting elements, the additional light-emitting element will typically be higher in luminance efficiency than even the green light-emitting element. In such a display, providing as much luminance as possible using the more efficient additional light-emitting element instead of the other light-emitting elements may reduce the power of the display. In such a case, the processor may further determine the triad mixing ratio values as a function of the relative efficiency of the light-emitting elements. One embodiment of such a method would be to use the control signal to determine when an edge is present such that it is desirable to employ the green light-emitting element for enhancing perceived resolution. To reduce power when it is not necessary to employ the green light-emitting element for resolution enhancement, the triad mixing ratio may be altered such that the additional light-emitting element, which has the higher luminance efficiency, is preferentially applied over the green light-emitting element, thereby decreasing the power consumption of the display device. For example, when the control signal does not indicate the presence of a strong edge, which might be indicated by a metric ratio that is close to 1 or a metric difference that is close to zero, the triad mixing ratio may be adjusted to allow the additional light-emitting element to produce more luminance than the green light emitting element.

Figure 7:
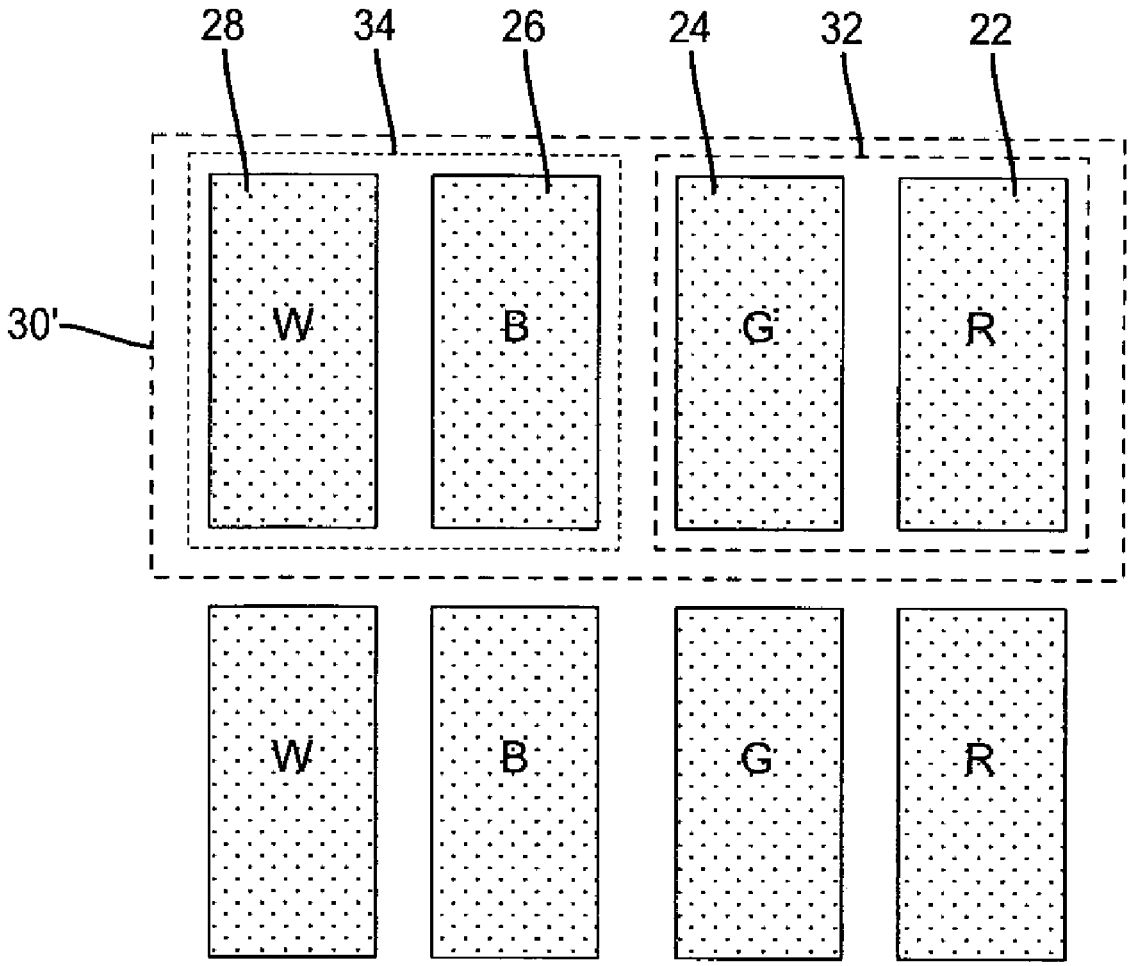
FIG. 7 is a schematic diagram of an arrangement of high and low luminance light-emitting elements that may be employed in an alternative embodiment of the present invention.

Although FIG. 6 shows a portion of a display employing one particular arrangement of light-emitting elements, other embodiments may also be employed. For example, an alternative embodiment is shown in FIG. 7. As shown in this figure, the light-emitting elements may be organized in stripes of a first high luminance light emitting element 24 and a second high luminance light-emitting element 28 separated by stripes of a first low luminance light-emitting element 22 and a second low luminance light emitting element 26 wherein, one high luminance 24 and one low luminance 22 form a first luma-chroma sub-group 32, the second high luminance 28 and second low luminance 26 light-emitting elements form a second luma-chroma sub-group 34 and each pair of luma-chroma sub-groups form a pixel (full-color group of light-emitting elements) 30. Within such an embodiment, the high luminance light emitting elements 24, 28 may provide green and white light while the low luminance light-emitting elements 22, 26 may provide red and blue light.

Figure 8:
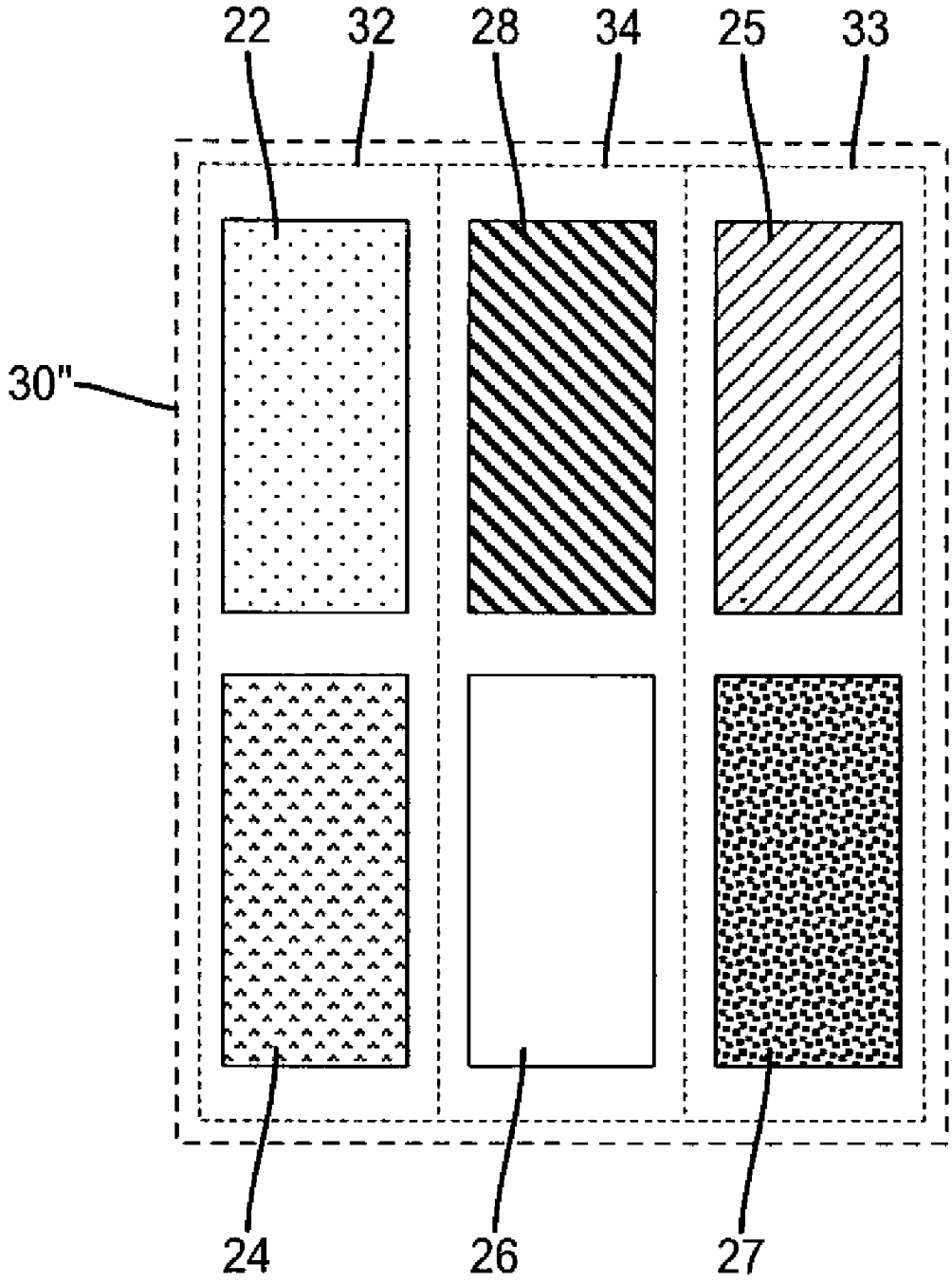
FIG. 8 is a schematic diagram an arrangement of high and low luminance light-emitting elements that may be employed in an alternative embodiment of the present invention having three luma-chroma sub-groups of light-emitting elements per pixel.

Multiple high-luminance light-emitting elements may further be employed within any luma-chroma sub-group of light-emitting elements and more than two luma-chroma sub-groups may be used to form a pixel. FIG. 8 depicts a pixel (full-color group of light-emitting elements) 30" comprising three luma-chroma sub-groups 32, 33, 34 of light-emitting elements. Wherein this pixel is composed of three high luminance light-emitting elements 24, 27, 28 and three low luminance light emitting elements 22, 25, 26, wherein each luma-chroma sub-group is comprised of both a high and a low luminance light-emitting element. One such display may employ green, cyan, and yellow high luminance light-emitting elements and magenta, red, and blue low luminance light-emitting elements to form a full-color display device.

The present invention may be employed in most flat-panel device configurations that include four-or-more light-emitting elements per pixel, possibly including OLED, LCD, or plasma display devices. These include very unsophisticated structures comprising a separate anode and cathode per light emitter to more sophisticated devices, such as passive matrix displays having orthogonal arrays of anodes and cathodes to form pixels, and active-matrix displays where each pixel is controlled independently, for example, with a thin film transistor (TFT). The present invention can be employed in either a top or bottom emitting OLED device of the types known in the prior art.

The invention has been described in detail with particular reference to certain preferred embodiments thereof, but it will be understood that variations and modifications can be effected within the spirit and scope of the invention.

PARTS LIST

10 processor
12 display
14 full color input image signal
16 signal for driving
22, 24, 25, 26, 27, 28 light-emitting element
30, 30', 30" full-color group of light-emitting elements
32, 33, 34 luma-chroma sub-group
40 receive input image signal step
42 provide image signal step
44 compute control signal step
46 render signal for driving step
47 first row
48 second row
50 display portion
52 red light-emitting element
54 green light-emitting element
56 blue light-emitting element
58 green light-emitting element
60 first pair of columns
61 first column
62 second pair of columns
63 second column
65 third column
67 fourth column
72 blue light-emitting element
74 green light-emitting element
76 red light-emitting element
78 green light-emitting element
80 data line
82 select line
84 select transistor
86 capacitor
88 power transistor
89*a*, 89*b* capacitor line
90, 92 power line
93 receive full color image signal step
94 convert to linear intensity values step
95 transform to luminance and chrominance step
96 filter step
98 calculate metric step
100 calculate control signal step
101 convert to linear intensity step
102 perform initial rendering step
104 calculate weighting values step
106 weight error signals step
108 determine final rendering value step
110 transform to drive values step
130 display portion
132, 134 full-color group of light-emitting elements
136 green light-emitting element
138 red light-emitting element

140 blue light-emitting element
142 white light-emitting element
144 blue light-emitting element
146 white light-emitting element
148 green light-emitting element
150 red light-emitting element
152 first row
154 second row
156 first column
158 second column
160 third column
162 fourth column
164 first pair of columns
166 second pair of columns

The invention claimed is:

1. A full-color display system having improved apparent resolution comprising:

a) a display formed from a two-dimensional array of three-or-more colors of light-emitting elements, the light-emitting elements arranged in a repeating pattern to form a number of full-color groups of light-emitting elements, each full-color group of light-emitting elements comprising more than one luma-chroma sub-group of light-emitting element; and b) a processor for receiving a full color input image signal that specifies full color image values at each of a two-dimensional number of sampled addressable spatial locations within an image to be displayed, for providing a full color image signal with different image signal values corresponding to the spatial location of each luma-chroma sub-group, for computing a control signal representing the relative values, or difference between values, for the image signal values corresponding to each luma-chroma sub-group and at least one of each luma-chroma sub-group's neighbors, and for rendering a signal for driving each light-emitting element within each luma-chroma sub-group of light-emitting elements as a function of the full color image signal values corresponding to each luma-chroma sub-group and the control signal, such that the display has a peak white luminance and each luma-chroma sub-group comprises at least one distinct high-luminance light-emitting element having a peak output luminance value that is 40 percent or greater of the peak white luminance of the display device.

2. The full-color display system according to claim 1, wherein the control signal is formed by computing a luminance value for values of the image signal corresponding to each luma-chroma sub-group and computing the relative values, or the difference between values, for the luminance value corresponding to each luma-chroma sub-group and the luminance value corresponding to at least one of its neighboring luma-chroma sub-groups.

3. The full-color display system according to claim 1, wherein the control signal is formed by computing a color value for values of the image signal corresponding to each luma-chroma sub-group; computing the relative value, or the difference between values, for the color value corresponding to each luma-chroma sub-group and the color value corresponding at least one of its neighboring luma-chroma sub-groups.

4. The full-color display system according to claim 1, wherein use of the full color image signal with image signal values corresponding to the spatial location of each luma-chroma sub-group to drive the available light-emitting elements within each corresponding luma-chroma sub-group will result in a chrominance or luminance error, and wherein the control signal is applied to determine one or more neighboring luma-chroma sub-groups to be employed when compensating the chrominance or luminance error, and the proportion of the chrominance or luminance error that is to be compensated by each neighboring luma-chroma sub-groups.

5. The full-color display system of claim 1, wherein the processor further computes one-or-more chrominance signals corresponding to each of the addressable spatial locations within the input image signal, and spatially filters at least one of the chrominance signals to produce a lower resolution chrominance signal.

6. The full-color display system of claim 1, wherein each full-color group of light-emitting elements comprises at least two green light-emitting elements for each red or blue light-emitting element.

7. The full-color display system of claim 1, wherein each full-color group of light-emitting elements comprises four-or-more colors of light-emitting elements.

8. The full-color display system of claim 7, wherein colors represented within the input image signal may be formed from multiple triad combinations of the four-or-more colors of light-emitting elements, and the processor performs a calculation to transform the full color image input signal to a four-or-more color signal for driving the full-color two-dimensional groups of light-emitting elements.

9. The full color display system of claim 8, wherein the calculation for transforming the full color image input signal to a four-or-more color signal for driving is performed separately for each luma-chroma sub-group of light-emitting elements.

10. The full color display system of claim 8, wherein the calculation for transforming the full color image input signal to a four-or-more color signal for driving is performed once for each full color group of light-emitting elements.

11. The full-color display system of claim 8 wherein the processor employs one or more triad mixing ratio values that are determined as a function of the control signal in the calculation for transforming the full color image input signal to a four-or-more color signal.

12. The full-color display system of claim 7, wherein the four-or-more colors of light-emitting elements comprise a red, a green, a blue, and at least one additional light-emitting element.

13. The display system according to claim 12, wherein the at least one additional color light-emitting element, comprises a white, yellow, green, or cyan light-emitting element.

14. The display system according to claim 7, wherein the light-emitting elements include equal numbers of white, red, green, and blue light-emitting elements and the light-emitting elements are formed in two-by-two arrays having diagonally opposed green and white light-emitting elements.

15. The display system according to claim 7, wherein each full-color group of light-emitting elements is formed from a pair of luma-chroma sub-groups, and wherein the relative positions of the luma-chroma sub-groups are exchanged in neighboring full-color groups in one dimension.

16. The display system according to claim 7, wherein the light-emitting elements include equal numbers of white, red, green, and blue light-emitting elements and the light-emitting elements are formed in stripes of common colored light-emitting elements, and wherein the stripes of green light-emitting elements are separated from the stripes of white light-emitting elements by stripes of red or blue light-emitting elements.

17. The display system according to claim 1, wherein each luma-chroma sub-group is substantially square.

18. A method for rendering a high-resolution full color input image signal to a three-or-more color signal for driving a display to improve the apparent resolution of a display formed from a two-dimensional array of three-or-more colors of light-emitting elements, the light-emitting elements arranged in a repeating pattern to form a number of full-color groups of light-emitting elements, each full-color group of light-emitting elements comprising more than one luma-chroma sub-group of light-emitting elements, the method comprising:

a) receiving a full color input image signal that specifies full color image values at each of a two-dimensional number of sampled addressable spatial locations within an image to be displayed, and providing a full color image signal with image signal values corresponding to the spatial location of each luma-chroma sub-group;

b) computing a control signal representing the relative values, or difference between values, for the image signal values corresponding to each luma-chroma sub-group and at least one of each luma-chroma sub-group's neighbors; and c) rendering a signal for driving each light-emitting element within each luma-chroma sub-group of light-emitting elements as a function of the full color image signal values corresponding to each luma-chroma sub-group and the control signal such that the display has a peak white luminance and each luma-chroma sub-group comprises at least one distinct high-luminance light-emitting element having a peak output luminance value that is 40 percent or greater of the peak white luminance of the display device.

19. The method of claim 18, wherein each full-color group of light-emitting elements comprises four-or-more colors of light-emitting elements and colors represented within the input image signal may be formed from multiple triad combinations of the four-or-more colors of light-emitting elements, and further comprising performing a calculation employing one or more triad mixing ratio values that are determined as a function of the control signal to transform the full color image input signal to a four-or-more color signal for driving the full-color two-dimensional groups of light-emitting elements.

20. A full-color display system having improved apparent resolution comprising:

a) wherein the display is an emissive display , formed from a two-dimensional array of four-or-more colors of light-emitting elements, the light-emitting elements arranged in a repeating pattern to form a number of full-color groups of light-emitting elements, each full-color group of light-emitting elements comprising more than one luma-chroma sub-group of light-emitting elements, the four-or-more colors of light-emitting elements comprise a red, a green, a blue, and at least one additional light-emitting element that has a higher luminance efficiency than the red, green, and blue light-emitting elements, wherein the emissive display has a peak white luminance and each luma-chroma sub-group comprises at least one distinct high-luminance light-emitting element having a peak output luminance value that is 40 percent or greater of the peak white luminance of the emissive display and each full-color group of light-emitting elements; and b) a processor for receiving a full color input image signal that specifies full color image values at each of a two-dimensional number of sampled addressable spatial locations within an image to be displayed, for providing a full color image signal with image signal values corresponding to the spatial location of each luma-chroma sub-group, for computing a control signal representing the relative values, or difference between values, for the image signal values corresponding to each luma-chroma sub-group and at least one of each luma-chroma sub-group's neighbors, and for rendering a signal for driving each light-emitting element within each luma-chroma sub-group of light-emitting elements as a function of the values for the image signal corresponding to each luma-chroma sub-group and the control signal, wherein colors represented within the input image signal are formed from multiple triad combinations of the four-or-more colors of light-emitting elements and the processor determines the triad mixing ratio values for triads employing the additional light emitting element relative to a triad employing the red, green and blue light emitting elements as a function of the control signal, such that when the control signal does not indicate the presence of a strong edge within the image specified by full color image values at the two-dimensional number of sampled addressable spatial locations corresponding to the spatial location for a luma-chroma sub-group and one or more neighboring luma-chroma sub-groups, the triad mixing ratio values are determined to allow the additional light-emitting element to produce more luminance than the green light emitting element.

* * * * *